US010252888B2

(12) United States Patent
Metsänen et al.

(10) Patent No.: US 10,252,888 B2
(45) Date of Patent: Apr. 9, 2019

(54) DRIVE MACHINE FOR AN ELEVATOR AND AN ELEVATOR

(71) Applicant: KONE Corporation, Helsinki (FI)

(72) Inventors: Aki Metsänen, Hyvinkää (FI); Jouni Lappalainen, Jokela (FI); Martti Juurioksa, Espoo (FI); Pekka Hallikainen, Hyvinkää (FI); Sakari Korvenranta, Hyvinkää (FI)

(73) Assignee: KONE CORPORATION, Helsinki (FI)

( * ) Notice: Subject to any disclaimer, the term of this patent is extended or adjusted under 35 U.S.C. 154(b) by 501 days.

(21) Appl. No.: 14/951,020

(22) Filed: Nov. 24, 2015

(65) Prior Publication Data

US 2016/0075536 A1 Mar. 17, 2016

Related U.S. Application Data

(63) Continuation of application No. PCT/FI2014/050433, filed on May 30, 2014.

(30) Foreign Application Priority Data

Jun. 5, 2013 (EP) ..... 13170638

(51) Int. Cl.
*B66B 1/36* (2006.01)
*B66B 9/00* (2006.01)
(Continued)

(52) U.S. Cl.
CPC ..... *B66B 11/04* (2013.01); *B66B 1/365* (2013.01); *B66B 9/00* (2013.01); *B66B 11/0476* (2013.01); *B66B 11/08* (2013.01); *B66D 5/14* (2013.01)

(58) Field of Classification Search
CPC .... B66B 11/04; B66B 11/0476; B66B 11/008
See application file for complete search history.

(56) References Cited

U.S. PATENT DOCUMENTS 724,504 A * 4/1903 Rice ..... B66D 1/26 187/252
9,604,821 B2 * 3/2017 Korvenranta ..... B66B 11/0476
(Continued)

FOREIGN PATENT DOCUMENTS

DE 199 48 946 A1 4/2001
DE 202 17 287 U1 3/2003
(Continued)

OTHER PUBLICATIONS

English Machine Translation of EP 2147884.*

*Primary Examiner* — Diem M Tran
(74) *Attorney, Agent, or Firm* — Birch, Stewart, Kolasch & Birch, LLP

(57) ABSTRACT

A drive machine for an elevator includes a motor module including at least a motor, a drive shaft, and a first transmission wheel, which are provided with a common rotational axis and connected coaxially to each other. The drive machine further includes a traction module including at least a traction wheel engageable with elevator hoisting ropes, and a second transmission wheel, which are provided with a common rotational axis and connected coaxially to each other. The motor module and the traction module are positioned side by side with their rotational axes parallel, such that the traction wheel and the drive shaft are side by side, and the first and second transmission wheels are side by side. The drive machine further includes an endless drive member passing around the first and second transmission wheels. An elevator comprising said drive machine is also disclosed.

20 Claims, 4 Drawing Sheets

(51) Int. Cl.

| | |
|---|---|
| ***B66D 5/14*** | (2006.01) |
| ***B66B 11/04*** | (2006.01) |
| ***B66B 11/08*** | (2006.01) |

(56) References Cited

U.S. PATENT DOCUMENTS

| | | | | |
|---|---|---|---|---|
| 2004/0206580 | A1* | 10/2004 | Ishii | B66B 7/021 187/264 |
| 2005/0087407 | A1 | 4/2005 | Fischer | |
| 2009/0101449 | A1* | 4/2009 | Breidenstein | H02K 16/04 187/277 |

FOREIGN PATENT DOCUMENTS

| | | | | |
|---|---|---|---|---|
| DE | 20 2004 008 403 | U1 | 9/2004 | |
| DE | 102016108349 | A1 * | 11/2017 | B66B 11/04 |
| EP | 1 550 630 | A2 | 7/2005 | |
| EP | 2 147 884 | A1 | 1/2010 | |
| EP | 2147884 | A1 * | 1/2010 | B66B 5/0087 |
| JP | 4-133988 | A | 5/1992 | |

* cited by examiner

DRIVE MACHINE FOR AN ELEVATOR AND AN ELEVATOR

This application is a Continuation of PCT International Application No. PCT/FI2014/050433 filed on May 30, 2014, which claims priority under 35 U.S.C § 119(a) to Patent Application No. 13170638.4 filed in Europe on Jun. 5, 2013, all of which are hereby expressly incorporated by reference into the present application.

FIELD OF THE INVENTION

The invention relates to a drive machine of elevator and an elevator. The elevator is in particular of the type meant for transporting passengers and/or goods.

BACKGROUND OF THE INVENTION

An elevator typically comprises a counterweight and an elevator car connected to each other with hoisting ropes. Typically, the elevator further comprises a drive machine having a motor-driven traction wheel around which the ropes pass. The drive machine is usually positioned in a machine room located close to the hoistway in which the elevator car and the counterweight travel.

In cases where a new elevator is installed in a new building, the building cannot always be designed in every way optimal for the elevator. For instance, the size and shape of the spaces available for the elevator are often limited. Nevertheless, the elevator needs to fulfill numerous requirements related to its performance and features. This makes it challenging to design one type of elevator suitable to function efficiently in many different elevator environments. The specific design of the hoisting function, including the drive machine and the rope arrangement, is dependent on the size and shape of the space where the elevator is to be installed, for instance. The drive machine, as well as the ropes, must be fitted in the available space with adequate operating clearances and such that they can be serviced and used safely. The hoisting function must also have capacity to provide an adequately great rated load for the elevator, i.e. an adequate maximal weight that is allowed to be transported. For ensuring the desired capacity, the size of the motor, as well as the power-transmitting components need to be dimensioned accordingly. Adaptability of the hoisting function size, maximum load and dimensioning are important for making the elevator suitable for various installation sites. Especially, modernization of old elevators requires often tailored elevator design, because the modernized elevator design is often very limited by the existing space and structures. Improvements in performance are normally also required for the elevator being modernized. For instance, it is common that the new elevator needs to fulfill numerous modern requirements related to energy-efficiency, space-efficiency, noise, maintenance, safety and economical aspects of manufacturing the elevator.

A drawback with the known drive machines has been that they have not fulfilled the above mentioned various requirements adequately well. Especially, they have not been adequately well adaptable to many different elevator environments in a compact manner with good capacity for load transport. This has lead to need for compromises. For example, in many cases the size of the drive machine has required a spacious machine room or tailoring the structures of the drive machine, the roping arrangement or the machine room in a special and sometimes complicated way. This has been problematic especially in modernization where the machine room of the existing elevator is very low or otherwise tight.

BRIEF DESCRIPTION OF THE INVENTION

An object of the invention is, in particular, to provide an improved drive machine for an elevator and an elevator. An object of the invention is, inter alia, to provide a drive machine for an elevator and an elevator, which are easily adapted to fit in various installation environments. It is brought forward embodiments, which provide installation of the hoisting function in a very space-efficient manner. Also, it is brought forward embodiments, which facilitate easy and safe maintenance of the elevator. Also, it is brought forward embodiments, which facilitate efficient modernization of an elevator. In particular, it is brought forward embodiments, which facilitate efficient modernization of an elevator with a machine room.

It is brought forward a new drive machine for an elevator, comprising a motor module comprising at least a motor, a drive shaft, and a first transmission wheel all provided with a common rotational axis ($X_1$) and connected coaxially to each other, the drive shaft particularly having the motor on one end and the transmission wheel on the other end. The drive machine further comprises a traction module comprising at least a traction wheel engageable with elevator hoisting ropes, and a second transmission wheel, all provided with a common rotational axis ($X_2$) and connected coaxially to each other. The motor module and the traction module are positioned side by side with their rotational axes ($X_1$, $X_2$) parallel, such that the traction wheel and the drive shaft are side by side, and the first and second transmission wheels are side by side. The drive machine further comprises an endless drive member passing around the first and second transmission wheels. This configuration where the drive shaft and the traction wheel are side by side provides a compact structure for the drive machine in all directions. Particularly considerable savings in space can be achieved, because this makes is possible to set the roping and the motor module in an overlapped configuration. In particular, it is possible to position the drive shaft within the loop formed by the hoisting ropes connected to the car and counterweight and passing around the traction wheel. The endless drive member together with the transmission wheels, positioned in the defined manner, provides for good adaptability of the drive machine by selecting the diameters of the transmission wheels so that the desired capacity for lifting is achieved. The drive machine is also well suitable for being used with various hoisting ratios, for example 1:1 or 2:1.

The motor is preferably an electric motor, as an electric motor is generally found to be well suitable for being used as a power source in elevator. In a preferred embodiment the motor comprises a motor body, a stator mounted stationary on the motor body, and a rotor mounted rotatingly on the motor body, and the drive shaft has the rotor coaxially on its first end and the transmission wheel coaxially on its second end. The motor body is preferably mounted on the frame of the drive machine.

In a preferred embodiment the motor, in particular the body, rotor and the stator thereof, is on one side of the radial projection of the traction wheel and the first transmission wheel is on the other, opposite, side of the radial projection of the traction wheel. This makes it possible to position the drive shaft within the loop formed by the hoisting ropes connected to the car and counterweight and passing around the traction wheel, and to guide the ropes close to the drive shaft.

In a preferred embodiment the drive shaft has a length radially free of motor module components between the motor, in particular the rotor thereof, and the transmission wheel, which radially free length is side by side with the traction surface of the traction wheel. The radially free length of the drive shaft has no motor module components radially around it. In particular, the whole length of the traction surface as measured in the axial direction of the traction wheel is within the radial projection of the radially free length of the drive shaft. In fact, it is preferable that the whole traction wheel is within the radial projection of the radially free length of the shaft, which provides that adequate clearances between these moving parts as well as the moving ropes.

In a preferred embodiment the drive shaft has a space free of motor module components radially around it, and the radial projection of the whole traction surface of the traction wheel is within the free space. Hereby, passage of the ropes close to the drive shaft can be facilitated.

In a preferred embodiment the drive shaft forms an extension of the rotor, the shaft being either fixed coaxially on the rotor or the shaft being integral with the rotor, on which extension the first transmission wheel is mounted at an axial distance from the motor, in particular from the rotor, the stator and the body thereof.

In a preferred embodiment the first transmission wheel is at an (axial) distance from the motor, in particular the rotor, the stator and the body thereof, and in that the radial projection of the whole traction surface is within said distance. This leaves more space between the motor and the first transmission wheel thereby providing clearance between the traction wheel and the drive shaft, as well as facilitating passage of the ropes close to the drive shaft.

In a preferred embodiment the drive machine comprises a brake for braking the traction wheel via a brake part connected to the traction wheel to rotate with it. The brake part is preferably connected fixedly to the to the traction wheel, which makes it possible to brake the traction wheel safely, reliably and simply, as the braking is not be performed via a complicated transmission.

In a preferred embodiment the brake is a floating caliper brake having a first brake part on opposite sides of said brake part connected to the traction wheel to rotate with it.

In a preferred embodiment the drive machine comprises a frame on which the motor module and the traction module are mounted. Preferably, the frame comprises a main frame and one or more sub-frames mounted stationary on the main frame. The frame forms a structure which can be used for mounting the drive machine. It also positions and supports the components mounted thereon.

In a preferred embodiment the first brake parts of the brake are mounted at least substantially non-rotatingly on the frame of the drive machine via at least one force sensor blocking the first brake parts from rotating. Based on the measurement of the sensor characteristics of the elevator state can be deduced, for example current load inside the elevator car. In particular, the brake is mounted via the force sensor, which is positioned between the brake, in particular the first brake part thereof, and the frame of the drive machine. The torque produced on the traction wheel by the car suspended by the hoisting roping causes the brake to lean on the sensor with a force depending on the weight of the load inside the car. The weight of the load inside the car can be deduced from the force thus directed on the sensor.

In a preferred embodiment it comprises a means for receiving the measurement from the sensor, which means is configured to deduce car load based on the measurement.

In a preferred embodiment the a traction module comprises said traction wheel engageable with elevator hoisting ropes, said second transmission wheel, and further a brake part all provided with a common rotational axis (x2) and connected fixedly and coaxially to each other.

In a preferred embodiment the drive machine comprises a brake for braking the traction wheel, and in that the brake comprises at least one first brake part mounted at least substantially non-rotatingly on the frame of the drive machine, and a second brake part connected to the traction wheel to rotate with it, and in that the brake is arranged to brake the traction wheel with the first brake part acting on the second brake part, preferably by engaging it with frictional contact.

In a preferred embodiment the second brake part and the second transmission wheel are positioned in axial direction on opposite sides of the traction wheel.

In a preferred embodiment the second brake part is a brake disc.

In a preferred embodiment the traction module comprises a shaft on which the traction wheel, the second transmission wheel and the second brake part rotate, the second brake part and the second transmission wheel on opposite sides of the traction wheel. The traction wheel and the second transmission wheel as well as the second brake part are preferably fixedly mounted on the shaft.

In a preferred embodiment the traction module comprises a shaft on which the traction wheel and the second transmission wheel are fixedly coaxially mounted.

In a preferred embodiment the brake, in particular the first brake part and/or the second brake part thereof, and the motor, in particular the rotor and/or the stator thereof, are side by side.

It is also brought forward a new elevator comprising an elevator car, a counterweight, a drive machine, and hoisting ropes connecting the car and counterweight and passing around a traction wheel of the drive machine. The drive machine is as defined above or anywhere else in the application.

In a preferred embodiment the drive machine is in a machine room above the hoistway in which the elevator car is arranged to travel.

In a preferred embodiment the drive machine is mounted such that the rotational axes ($X_1$, $X_2$) are horizontal.

In a preferred embodiment the drive machine is positioned such that the drive shaft is within the loop formed by the hoisting ropes connected to the car and counterweight and passing around the traction wheel.

In a preferred embodiment the hoisting ropes pass from the traction wheel on the first side of it to the counterweight and on the second side of it to the elevator car and in that the drive shaft is between the portion of the hoisting ropes passing from the traction wheel to the counterweight and the portion of the hoisting ropes passing from the traction wheel to the elevator car.

In a preferred embodiment the hoisting ropes pass from the traction wheel on the first side of it to a first diverting wheel and further to the counterweight and on the second side of it to a second diverting wheel and further to the elevator car and in that the drive shaft is between the portion of the hoisting ropes passing from the traction wheel to the first diverting wheel and the portion of the hoisting ropes passing from the traction wheel to the second diverting wheel.

In a preferred embodiment the first and second diverting wheels as well as the drive shaft are both all horizontally on the same side of the traction wheel at different horizontal distances thereof. Thus, a wide contact angle can be provided for the ropes with a low drive machine structure. The hoisting ropes pass from the traction wheel to the counterweight via the first diverting wheel, the ropes turning on first diverting wheel, and the hoisting ropes pass from the traction wheel to the elevator car via the second diverting wheel, the ropes turning on second diverting wheel in the same direction (in terms of clockwise/counterclockwise) as on the first diverting wheel.

In a preferred embodiment the drive machine is positioned such that the drive shaft is within the vertical height of the traction wheel, which facilitates space-efficiency of the drive machine in vertical direction.

In a preferred embodiment the ropes, in particular the ropes passing from the traction wheel to a first diverting wheel, pass close to the drive shaft via the axial projection of the motor body. Alternatively or in addition to the the latter, the ropes, in particular the ropes passing from the traction wheel to a first diverting wheel, pass close to the drive shaft via the space free of motor module components radially around the drive shaft. Hereby, the overall configuration of the drive machine and the ropes is space-efficient in vertical direction.

In a preferred embodiment the drive machine is located at the side of the vertical projection of the hoistway. The elevator can thus utilize free space of the landing for instance. Hereby, the elevator can be formed very space-efficient in vertical direction. In particular, the elevator can thus be formed without a machine room above the hoistway and the car can be arranged to travel close to the hoistway ceiling.

The elevator as described anywhere above is preferably, but not necessarily, installed inside a building. The elevator is preferably of the type where the car is arranged to serve two or more landings. Then, the car preferably responds to calls from landing and/or destination commands from inside the car so as to serve persons on the landing(s) and/or inside the elevator car. Preferably, the car has an interior space suitable for receiving a passenger or passengers.

BRIEF DESCRIPTION OF THE DRAWINGS

In the following, the present invention will be described in more detail by way of example and with reference to the attached drawings, in which.

DETAILED DESCRIPTION

Figure 1A:
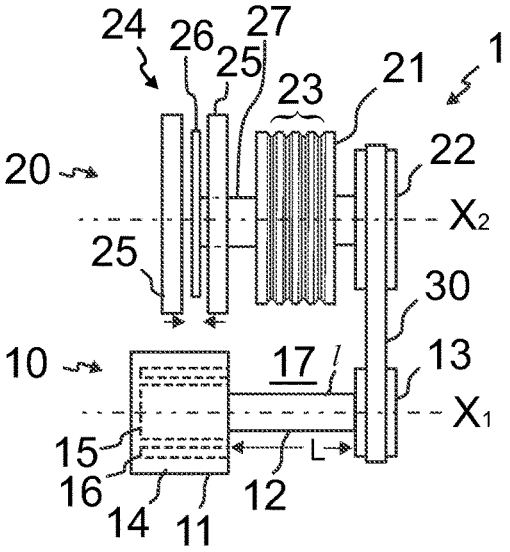
FIG. 1*a* illustrates a drive machine for an elevator according to a preferred embodiment as viewed in radial direction of the traction wheel.
Figure 1B:
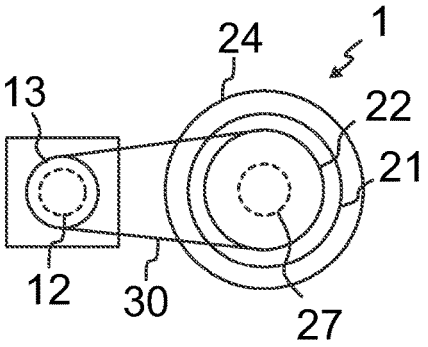
FIG. 1*b* illustrates the drive machine of FIG. 1*a* as viewed in axial direction of the traction wheel.
Figure 2A:
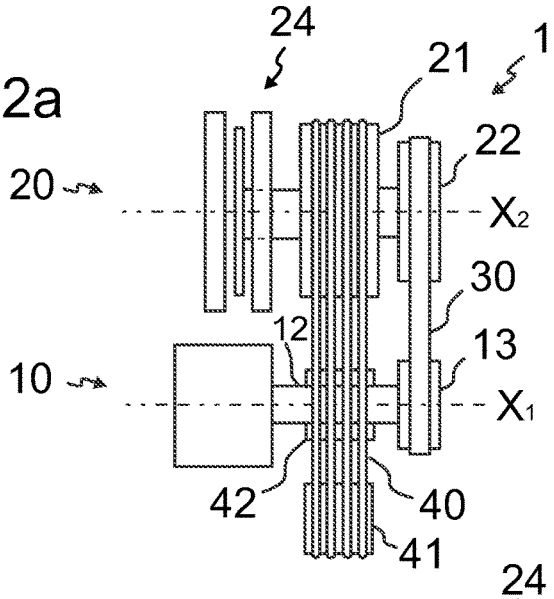
FIG. 2*a* illustrates the drive machine of FIGS. 1*a*-1*b* with roping as viewed in radial direction of the traction wheel.
Figure 2B:
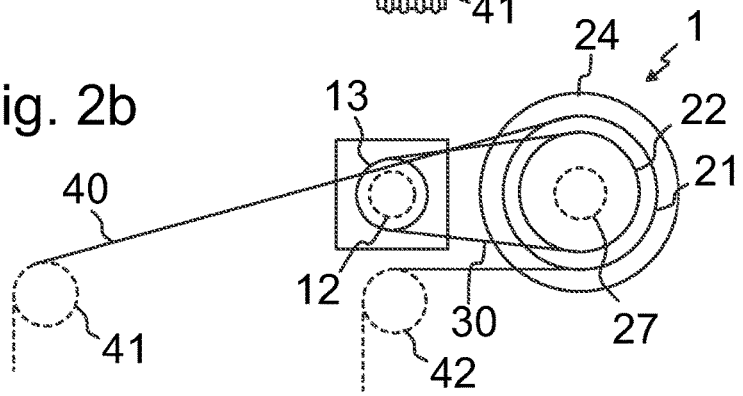
FIG. 2*b* illustrates the drive machine of FIGS. 1*a*-1*b* with roping as viewed in axial direction of the traction wheel.

FIGS. 1*a* and 1*b* illustrate a drive machine 1 for an elevator according to a preferred embodiment. FIGS. 2*a* and 2*b* illustrate this drive machine when a roping 40 of an elevator is guided to pass around the traction wheel 21 of the drive machine 1. The drive machine 1 comprises a motor module 10 and a traction module 20 positioned side by side and connected to each other. For the purpose of braking the rotation of the traction wheel 21, the drive machine 1 comprises a brake 24. The drive machine 1 further comprises a frame (not shown in FIGS. 1*a* and 1*b*) on which the motor module 10 and the traction module 20 are mounted. The motor module 10 comprises a motor 11, a drive shaft 12, and a first transmission wheel 13 all provided with a common rotational axis $X_1$ and connected coaxially to each other the drive shaft 12 having the motor 11 on one end and the transmission wheel 13 on the other end. The traction module 20 comprises a traction wheel 21, which is engageable with elevator hoisting ropes 40, and a second transmission wheel 22, and a brake part 26 of said brake 24, which are all provided with a common rotational axis $X_2$ and connected fixedly and coaxially to each other so that they can rotate together as a uniform structure around the common rotational axis $X_2$. The motor module 10 and the traction module 20 are positioned side by side with their rotational axes $X_1$, $X_2$ parallel, in such a configuration that the traction wheel 21 and the drive shaft 12 are side by side, and also the first transmission wheel 13 and second transmission wheels 22 are side by side.

The drive machine 1 further comprises an endless drive member 30 passing around the first and second transmission wheels 13, 22, thus connecting the modules 10 and 20 to each other in a force transmitting manner. Thereby, rotation produced by the motor 11 of the motor module 10 is transmitted by the drive shaft 12 to the first transmission wheel 13, and therefrom further to the second transmission wheel 22 by the endless drive member 30, and therefrom further to the traction wheel 21 via the fixed connection between the second transmission wheel 22 and the traction wheel 21. The endless drive member 30 is in the preferred embodiment in the form of a cogged transmission belt, the transmission wheels 13 and 22 being cogged as well. Alternatively, the endless drive member may be in the form of a transmission chain or a belt with polyvee-shape in which case the transmission wheels 13 and 22 would be provided polyvee-shape as well.

The configuration where the drive shaft 12 and the traction wheel 21 are side by side provides a compact structure for the drive machine 1 in all directions.

Particular savings in space are achieved because this makes is possible to set the roping 40 and the motor module in an overlapped configuration. In particular, it is possible to position the motor module inside between the portion of the roping 40 passing to the traction wheel 21 and the portion of the roping 40 passing from the traction wheel 21. The dimensions of the motor module can with this configuration be very small so the roping 40 passing to the traction wheel 21 and the portion of the roping 40 passing from the traction wheel 21 can be guided very close to each other. Thus, the combinatory space consumption of the drive machine 1 and the roping 40 is reduced, and the overall structure very compact.

The motor 11 may be of any known type motor for producing rotation movement. It is preferable that the motor 11 is an electric motor, for example a permanent magnet motor. In the preferred embodiment, as illustrated in FIGS. 1*a*-1*b*, the motor 11 is an electric motor and comprises a motor body 14, a stator 16 mounted stationary on the motor body 14, and a rotor 15 mounted rotatingly on the motor body 14. The drive shaft 12 has the rotor 15 of the motor 11 coaxially on its first end and the first transmission wheel 13 coaxially on its second end, the rotor 15, the drive shaft 12 and the first transmission wheel 13 being fixedly and coaxially connected to each other so that they can rotate together as a uniform structure around their common rotational axis $X_1$.

For making it possible to guide the ropes 40 of the elevator close to the motor module 10 and/or for making it possible to guide the ropes 40 of the elevator to and from the traction wheel 21 close to each other the motor 11 (in particular the body 14, rotor 15 and the stator 16 thereof) is (are) on one side of the radial projection of the traction wheel 21, and the first transmission wheel 13 is on the other, opposite, side of the radial projection of the traction wheel 21. The drive shaft 12 forms an extension of the rotor 16, the drive shaft 12 being either fixed coaxially on the rotor 16 or the drive shaft 12 being integral with the rotor 16, on which extension the first transmission wheel 13 is mounted at a distance L from the motor 11, in particular from the rotor 15, the stator 16 and the body 14 thereof. The modules 10,20 are positioned such that the radial projection of the whole traction surface 23 is within said distance L.

So as to make it possible to guide the ropes 40 very close to the drive shaft 12, drive shaft 12 has a length I radially free of motor module-components (thereby it has no motor module-components immediately around it) between the motor 11, in particular the rotor 15 thereof, and the transmission wheel 13, which radially free length I is side by side with the a traction surface 23 of the traction wheel 21. In particular, the whole length of the traction surface 23 as measured in the axial direction of the traction wheel 21 is within the radial projection of the radially free length of the drive shaft 12. In fact, it is preferable that the whole traction wheel 21 is within the radial projection of the radially free length I of the drive shaft 12, as illustrated, so the traction wheel 21 can be placed close to the motor module 10 and still a safe clearance between the traction wheel 21 and the motor module 10 can be ensured. The drive shaft 12 has a space 17 free of motor module components radially around it, and the radial projection of the whole traction surface 23 of the traction wheel 21 is within the free space 17. The hoisting ropes are guided to pass via this free space 17. The traction surface preferably comprises grooves for receiving ropes 40, which ropes 40 may be in the form of belts or are round in cross section.

As mentioned above, the drive machine 1 comprises a brake 24 suitable for braking the rotation of the traction wheel 21. FIG. 1*a* illustrates the preferred structure for the brake 24. The brake 24 is arranged to brake the rotation of the traction wheel 21 via a brake part 26 (also referred to as second brake part), which is connected to the traction wheel 21 such that it rotates with the traction wheel 21. The rotation of the traction wheel 21 is thus arranged to be braked by braking the rotation of the brake part 26. The second brake part 26 is in the preferred embodiment a brake disc mounted fixedly on the shaft 27 of the traction module 20.

In the preferred embodiment, as illustrated in FIG. 1*a*, the brake 24 comprises in addition to said brake part 26, at least one brake part 25 mounted at least substantially non-rotatingly (later referred to as first brake part 25). The brake 24 is arranged to brake the traction wheel 21 with the first brake part 25 acting on the second brake part 26. Preferably, the brake 24 is of the type where the brake 24 is arranged to brake the traction wheel 21 with the first brake part 25 acting on the second brake part 26 by engaging it with frictional contact. In the preferred embodiment, so as to enable the engagement the first brake part(s) 25 is/are movable in axial direction of the traction module 20 to and from frictional contact with the second brake part 26, as illustrated with arrows in FIG. 1*a*.

The second brake part 26 and the second transmission wheel 22 are positioned in axial direction on opposite sides of the traction wheel 21. This facilitates compactness of the traction module as well as that of the drive machine. In particular, the brake 24, such as the first brake part 25 and/or second brake part 26 thereof, and the motor 11, in particular the rotor 15 and/or the stator 16 thereof, can in this way be positioned side by side. This facilitates further the compactness of the drive machine. These components 24 and 11 of the elevator have mutually substantially same low need for maintenance. On the other hand, the endless drive member 30, as well as the transmission wheels 13, 22 all have a higher need for maintenance. Having them on the same side facilitates efficiency of maintenance, as they can be accessed simultaneously, and the drive machine can be positioned so that these components requiring frequent maintenance are easily accessible in terms of free space of the machine room.

Figure 3:
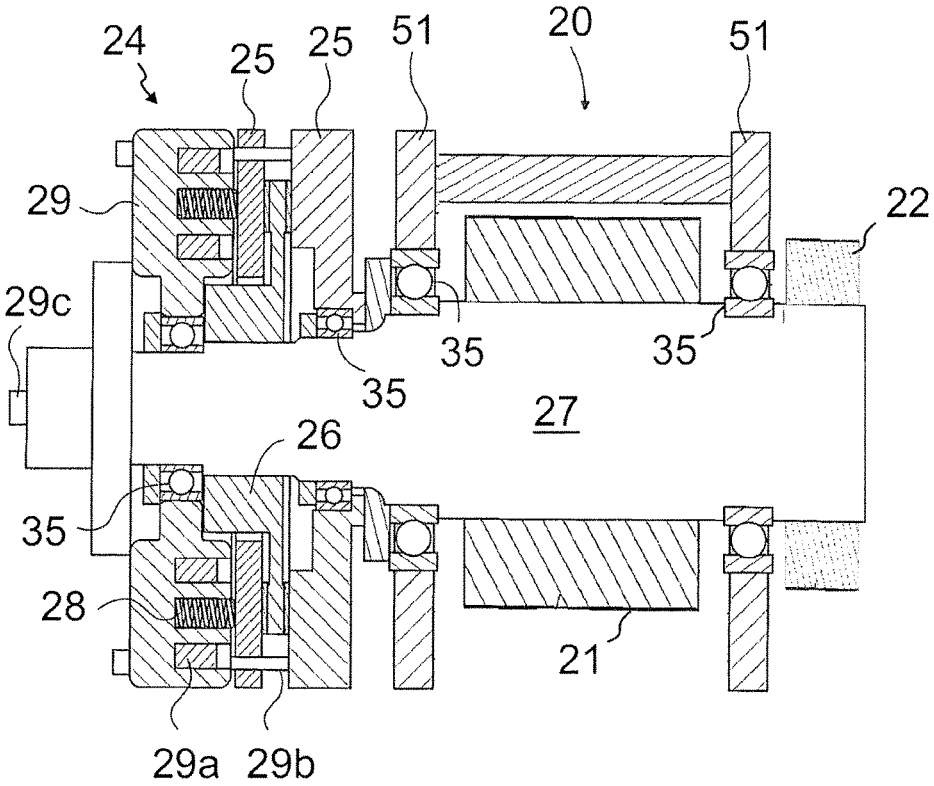
FIG. 3 illustrates the traction module of FIG. 1*a* with further preferable details.
Figure 4:
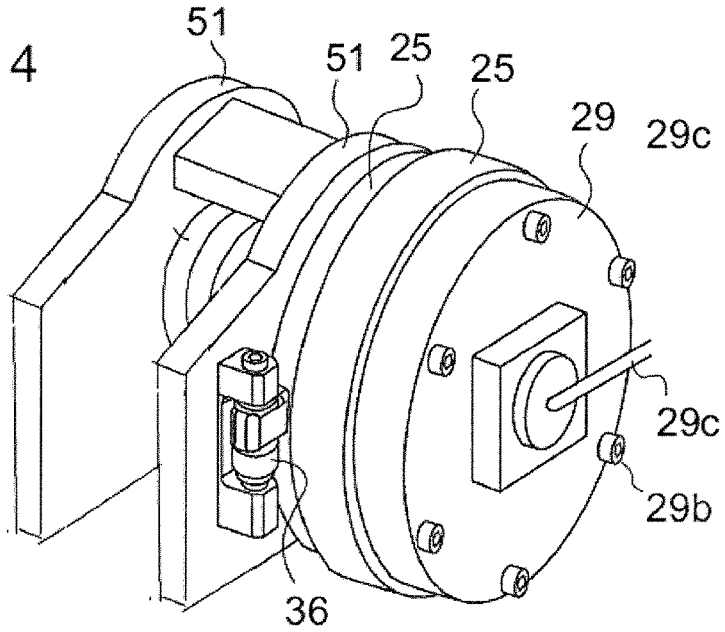
FIG. 4 illustrates three-dimensionally the traction module of FIG. 3.

FIGS. 3 and 4 illustrate further preferable details for the traction module 20 of the drive machine 1. As illustrated, the traction module 20 comprises a shaft 27 on which the traction wheel, the second transmission wheel 22 and the second brake part 26 rotate, the second brake part 26 and the second transmission wheel 22 on opposite sides of the traction wheel 21. The traction wheel 21 and the second transmission wheel 22 as well as the second brake part 26 are fixedly and coaxially mounted on the shaft 27. The brake 24 comprises in addition to said second brake part 26 first brake parts 25 mounted at least substantially non-rotatingly. The first brake parts 25 are mounted preferably on a frame 51 of the drive machine which frame 51 is mounted stationary, e.g. on the building or any other stationary structure of the installation site. The brake 24 is of a floating-caliper type. Thereby, there is a first brake part 25 on opposite sides of the second brake part 26 mounted on a brake caliper 29, both of the first brake parts 25 being movable in axial direction of the traction module 10 to and from contact with the second brake part 26. The brake caliper on the other hand is mounted slightly movably in axial direction of the traction module 10, most preferably on a frame part 51 of the drive machine on which also the shaft 27 is mounted. In the preferred embodiment as illustrated in FIGS. 3 and 4, the first brake parts 25 have a common actuation means 28 for providing the force urging them in opposite directions, i.e. towards the second brake part 26. Both of the first brake parts 25 are mounted movable in axial direction of the traction module 10, so that when the actuation means 28 urges the first brake parts 25 towards each other, they move in said axial direction and press against the second brake part 26 positioned between them. As the brake is of floating caliper type, the actuation means 28 urge one of the first brake parts 25 towards the second brake part 26 on one side of the second brake part 26, and take the reaction force for this from the other of the second brake parts 26, which is positioned on the opposite side of the second brake part 26. Thereby, said urging forces for the first brake parts 25 on opposite sides of the second braking part 26, as well as clearances between brake parts are equalized. The control of the brake is provided for by means for working against the actuation means, which may comprise electrically activatable magnets 29*a*. The actuation means 28 comprises in the preferred embodiment at least one spring 28 urging the first brake parts 25 towards each other. The particular solution as illustrated in FIGS. 3 and 4 comprises a brake caliper in the form of a body 29 provided with electrically activatable magnets 29*a*, which may be in the form of electrical coils. One (the left one) of the first brake parts 25 is axially movable relative to the magnet body in one direction by the force of the springs and in one direction by the force of the magnet(s) 29*a*. The magnet body 29 is connected at least in axial direction immovably with the first brake part 25 (the right one) on the opposite side of the second brake part 26 by bolts 29*b* or equivalent. Thus, when the spring 28 urges the left one of the first brake parts 25 towards the second brake part 26 on left side of the second brake part 26, it takes the reaction force for this urging from the other of the second brake parts 26, which is positioned on the right side of the second brake part 26, via the bolts 29*b*. The electrically activatable magnets 29*a* are in the preferred embodiment empowered with a cable 29*c* for feeding electricity. FIG. 3 illustrates further the roller bearings 35, which enable friction free rolling between the shaft 27 and the parts of the brake, which do not rotate freely with the shaft 27 and the traction wheel 21. The floating caliper brake may alternatively be of some other type than magnetically controlled. For instance, it may instead of a magnetic means comprise a mechanical or hydraulic means for working against the actuation means 28, which mechanical or hydraulic means are known to be used with floating brakes for instance in car brakes. Such activating means may for example comprise a cord-operated lever system for providing the force needed for opening the brake.

The first brake parts 25 can be mounted completely non-rotatingly with respect to the frame F of the drive machine, i.e. not to rotate with the drive wheel 21. However, the first brake parts 25 can be mounted at least substantially non-rotatingly, which means that the first brake parts 25 are mounted such that they can be rotated within a slight margin, preferably within a margin which does not exceed 5 degrees. The ability of the first brake parts 25 to rotate slightly may be needed particularly in the preferred embodiment as illustrated in FIGS. 3 and 4, where the first brake parts 25 are mounted at least substantially non-rotatingly via a sensor 36, which is positioned to block the brake parts 25 from rotating, thereby providing reaction force for the brake 24. This reaction force provided by the sensor 36 blocks the traction wheel 21 from rotating when the brake 24 is in a braking state. The sensor 36 is arranged to measure the force with which the first brake parts 25 direct on it when the brake 24 is in a braking state. Based on this measurement it is deduced characteristics of the elevator state, for example current load inside the elevator car. The brake 24 is preferably mounted on a frame F of the drive machine 1. As illustrated in FIGS. 3 and 4, the brake is mounted on a sub-frame 51, which forms part of the frame F of the drive machine 1. The sensor 36 may be any kind of force sensor sensing pressure and/or tension. It may be, for example, in the form of a strain gauge or a compression gauge, or both of these. The drive machine 1 preferably comprises a means for receiving the measurement from the sensor 36, which is configured to deduce car load based on the measurement. Thus, a very simple way to measure the car load is provided. Such means may comprise a programmable microprocessor for carrying out said deducing. Said means may be comprised in the elevator control, for example. Thus, the car load can be simply utilized by the elevator control. As explained, slight ability to rotate may be preferable due to a particular structure of the sensor 36. There are, however, force sensors commercially available which do not necessitate considerable movement. The sensor 36, as well as the brake can be more specifically constructed according to what is disclosed in patent application FI20125608.

As the brake 24 is always applied when the loading or unloading of the car occurs, the change in weight of the car is translated directly to torque applying on the brake 24 via the ropes 40 and traction wheel 21. The floating nature of the brake 24 allows this torque to be measured by the sensor 36 and hence translated to a current signal to be used in deducing the load. In addition or as an alternative to acting as a load weighing device, the sensor can be used to improve ride comfort. As the sensor 36 measures the actual torque present in the system, the drive machine can adjust its current-levels to provide a smoother acceleration ramp. If the sensor measures both the tension and compression directed on it, it can further provide the drive machine with the directional information of the torque affecting the traction wheel.

Figure 5:
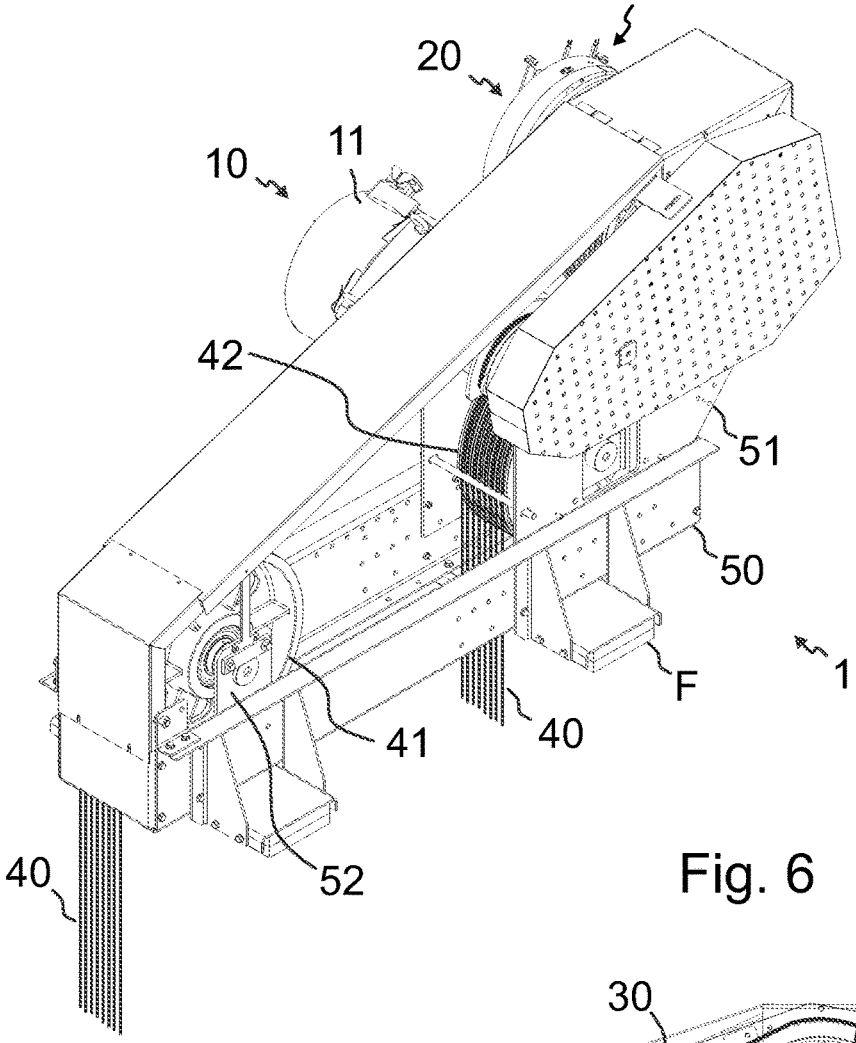
FIG. 5 illustrates three-dimensionally the drive machine of FIG. 1*a* with further preferable details together with hoisting ropes.
Figure 6:
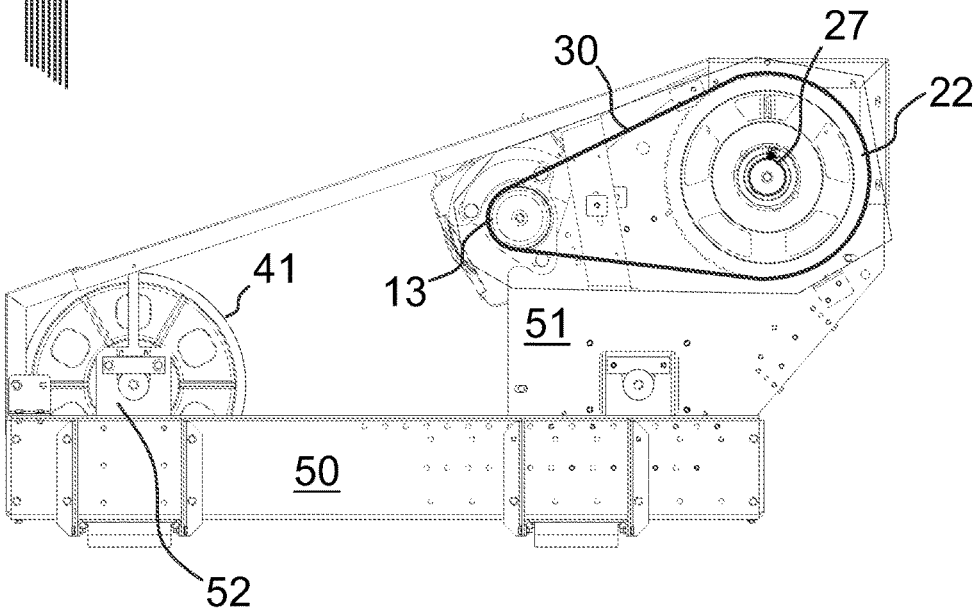
FIG. 6 illustrates the drive machine of FIG. 5 as viewed in axial direction of the traction wheel.

It is possible to mount the traction module 20 and the motor module 10 without a common frame. However, to facilitate their positioning, the drive machine 1 preferably comprises a frame F on which the motor module 10 and the traction module 20 are mounted, and via which the modules 10, 20 can be mounted in the desired position. FIGS. 5 and 6 illustrate further preferable details for the drive machine 1. The drive machine 1 comprises a frame F on which the motor module 10 and the traction module 20 are mounted. Also, the diverting wheels 41 and 42 are mounted on the frame F. So as to provide adaptability for plural different elevator environments, the second diverting wheel 42 is mounted adjustably in terms its position relative to the first diverting wheel 41. In particular, referring to FIG. 6, the horizontal distance of the second diverting wheel 42 relative to the traction wheel 21 is adjustable. For the purpose of enhanced adaptability to different configurations, the frame F is provided with a main frame 50 and a first sub-frame 51, on which sub-frame 51 the modules 10 and 20 and the second diverting wheel are mounted, which sub-frame 51 can be mounted stationary on the main frame 50 in several positions. Likewise, it is preferable that the frame F is provided with a second sub-frame 52 on which the first diverting wheel 41 is mounted and which sub-frame 52 can be mounted on the main frame 50 stationary in several positions. Thus, the best relative position of the diverting wheels 41,42 can be chosen according to the installation site and adjusted accordingly. To enhance the adaptability even further it is possible that the frame F is provided with yet a third sub-frame (not shown) on which the second diverting wheel is mounted and which sub-frame 53 can be mounted on the main frame 50 in several positions. Thus, also the position of the second diverting wheel can be adjusted optimal relative to the modules 10, 20. The drive machine 1 is also provided with protective covers as illustrated.

Figure 7:
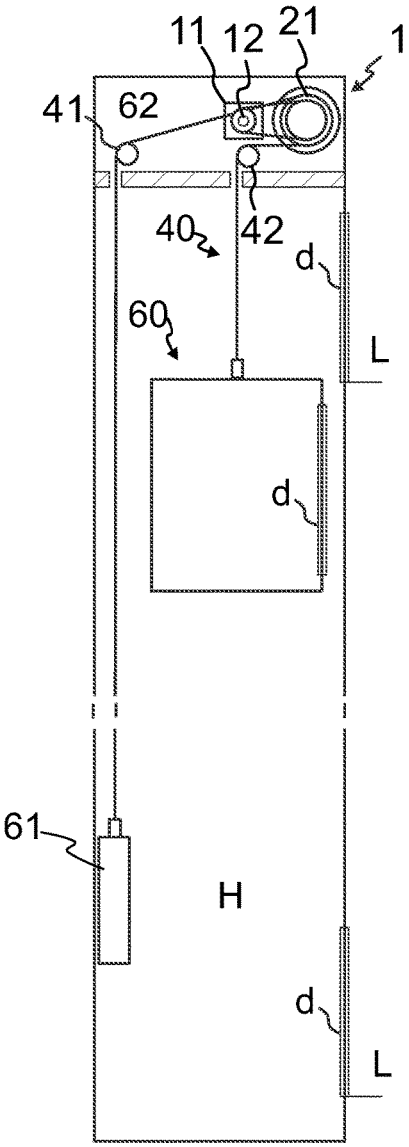
FIG. 7 illustrates an elevator according to a first preferred embodiment comprising a drive machine as illustrated in FIGS. 1*a*-2*b*.
Figure 8:
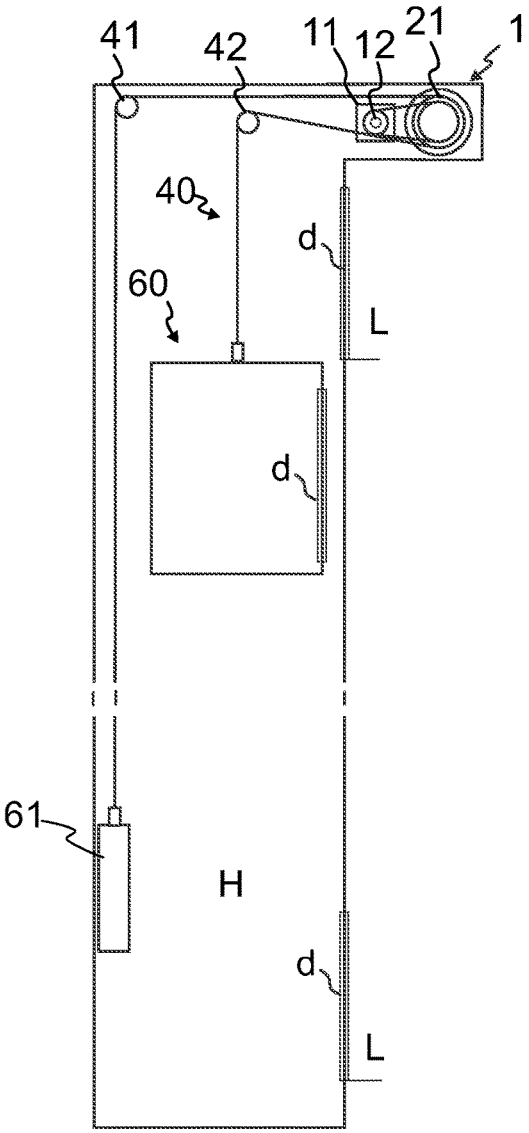
FIG. 8 illustrates an elevator according to a second preferred embodiment comprising a drive machine as illustrated in FIGS. 1*a*-2*b*.

FIGS. 7 and 8 illustrate each an elevator comprising a drive machine 1 as illustrated in FIGS. 1*a* to 2*b*. However, the elevator of FIG. 4 has the difference to what is shown in FIG. 2*b* that the diverting wheels 41 and 42 are positioned slightly differently in vertical direction. In each embodiment, the elevator comprises an elevator car 60, a counterweight 61, a drive machine 1, hoisting ropes 40 connecting the car 60 and counterweight 61 and passing around a traction wheel 21 of the drive machine. The drive machine 1 preferably further comprises the preferred details as described with reference to FIGS. 3-6 and illustrated therein. The drive machine 1, having its motor module 10 and traction module 20 side by side, is mounted such that the rotational axes $X_1$, $X_2$ of the motor module 10 and traction module 20 are parallel and horizontal. The drive machine 1 is positioned such that the drive shaft 12 is within the loop formed by the hoisting ropes 40 connected to the car 60 and counterweight 61 and passing around the traction wheel 21. The hoisting ropes 40 pass from the traction wheel 21 on the first side of it to a first diverting wheel 41 and further to the counterweight 61 and on the second side of it to a second diverting wheel 42 and further to the elevator car 60. The drive shaft 12 is between the portion of the hoisting ropes 40 passing from the traction wheel 21 to the first diverting wheel 41 and the portion of the hoisting ropes 40 passing from the traction wheel 21 to the second diverting wheel 42. The first and second diverting wheels 41, 42, as well as the drive shaft, are all horizontally on the same side of the traction wheel at different horizontal distances therefrom. The arrangement can be implemented very low, and therefore the height of the space (machine room in FIG. 7, and a machine accommodating box in FIG. 8) can be very low. Thus, the drive machine can be used for modernization of old elevators whatever the size of their machine room is, as well as for providing completely new elevators with excellent space-efficiency. The hoisting ropes 40 pass from the traction wheel 21 to the counterweight 61 via the first diverting wheel 41 the ropes turning on first diverting wheel 41, and the hoisting ropes 40 pass from the traction wheel 21 to the elevator car 60 via the second diverting wheel 41 the ropes 40 turning on second diverting wheel 42 in the same direction (in terms of clockwise/counterclockwise; here counterclockwise) as on the first diverting wheel 41. The drive machine 1 is positioned such that the drive shaft 12 is within the vertical height of the traction wheel 21, which further facilitates the space-efficiency of the elevator in vertical direction. The second diverting wheel 42 is at a smaller horizontal distance from the traction wheel than the first diverting wheel 41, which makes it possible that the ropes can drop to the hoistway H at horizontal distance from each other. The ropes 40 pass close to the drive shaft 12 via the space 17 free of motor module components radially around the drive shaft 12. In each embodiment, the car 60 is accessible from the landings L via doors d.

The elevators as presented in FIGS. 7 and 8 differ in the following aspects. In FIG. 7, the drive machine 1 is in a machine room 52 above the hoistway H in which the elevator car 50 is arranged to travel. The second diverting wheel 42 is below the drive shaft 12. The first and second diverting wheels 41, 42 are both positioned lower than the drive shaft 12 and the traction wheel 21. The ropes 40, in particular the ropes 40 passing from the traction wheel 21 to the first diverting wheel 41, pass close to the drive shaft 12 via the axial projection of the motor 11. The ropes 40 pass via holes in the floor of the machine room 62.

In FIG. 7, the drive machine 1 is accommodated in a box, which is at the side of the vertical projection of the hoistway H in which the elevator car 50 is arranged to travel. Said box is positioned outside the hoistway H within the landing space above a door d leading to the hoistway H. In this embodiment the ropes 40 passing from the traction wheel 21 to the second diverting wheel 42 pass close to the drive shaft 12 via the axial projection of the motor 11.

As described above the motor module 10 and the traction module 20 are positioned side by side. Also, the traction wheel 21 and the drive shaft 12 are positioned side by side. Also, the first and second transmission wheels 13,22 are positioned side by side. With the term side by side it is meant that the components positioned side by side are positioned in the axial direction of the modules such that the radial projections of the components positioned side by side overlap. In most cases it is preferable to position the drive machine 1 in such an angle that the axes of the modules are at least substantially on the same vertical level, as illustrated in the Figures. However, the drive machine 1 could of course be positioned in any desired angle, for example in such an angle that the axes of the modules are at least substantially superimposed. By this kind of mounting angle the drive machine 1 provides space savings in horizontal direction.

It is to be understood that the above description and the accompanying Figures are only intended to illustrate the present invention. It will be apparent to a person skilled in the art that the inventive concept can be implemented in various ways. The invention and its embodiments are not limited to the examples described above but may vary within the scope of the claims.

The invention claimed is:

1. A drive machine for an elevator, comprising:

a motor module comprising at least a motor, a drive shaft, and a first transmission wheel provided with a common rotational axis and connected coaxially to each other; and a traction module comprising at least a traction wheel engageable with elevator hoisting ropes, and a second transmission wheel, provided with a common rotational axis and connected coaxially to each other, wherein the entirety of the second transmission wheel is separate from and axially spaced from the traction wheel along the common rotational axis, and wherein the motor module and the traction module are positioned side by side with their rotational axes parallel, such that the traction wheel and the drive shaft are side by side, and the first and second transmission wheels are side by side, and wherein the drive machine further comprises an endless drive member passing around the first and second transmission wheels.

2. The drive machine according to claim 1, wherein the motor comprises a motor body, a stator mounted stationary on the motor body, and a rotor mounted rotatingly on the motor body, and wherein the drive shaft has the rotor coaxially on its first end and the transmission wheel coaxially on its second end.

3. The drive machine according to claim 2, wherein the motor is on one side of the radial projection of the traction wheel, and the first transmission wheel is on the other, opposite, side of the radial projection of the traction wheel.

4. The drive machine according to claim 2, wherein the drive shaft has a length radially free of motor module components between the motor and the transmission wheel, which radially free length is side by side with the traction surface of the traction wheel.

5. The drive machine according to claim 1, wherein the motor is on one side of the radial projection of the traction wheel, and the first transmission wheel is on the other, opposite, side of the radial projection of the traction wheel.

6. The drive machine according to claim 1, wherein the drive shaft has a length radially free of motor module components between the motor and the transmission wheel, which radially free length is side by side with the traction surface of the traction wheel.

7. The drive machine according to claim 1, wherein the first transmission wheel is at an axial distance from the motor, and wherein a radial projection of a whole traction surface is within said axial distance.

8. The drive machine according to claim 1, wherein the drive machine comprises a brake for braking the traction wheel via a brake part connected to the traction wheel to rotate with it.

9. The drive machine according to claim 8, wherein the brake is a floating caliper brake having a first brake part on opposite sides of said brake part connected to the traction wheel to rotate with it.

10. The drive machine according to claim 9, wherein the first brake parts of the brake are mounted at least substantially non-rotatingly via at least one force sensor blocking the first brake parts from rotating.

11. The drive machine according to claim 10, wherein the sensor is configured to measure force from the first brake parts, and wherein the sensor is configured to deduce car load based on the measured force.

12. The drive machine according to claim 1, wherein the traction module comprises said traction wheel engageable with elevator hoisting ropes, said second transmission wheel, and further a brake part all provided with a common rotational axis and connected fixedly and coaxially to each other.

13. The drive machine according to claim 1, wherein the drive machine comprises a brake for braking the traction wheel, and wherein the brake comprises at least one first brake part mounted at least substantially non-rotatingly, and a second brake part connected to the traction wheel to rotate with it, and wherein the brake is arranged to brake the traction wheel with the first brake part acting on the second brake part.

14. The drive machine according to claim 1, wherein the second brake part and the second transmission wheel are positioned in axial direction on opposite sides of the traction wheel.

15. The drive machine according to claim 1, wherein the traction module comprises a shaft on which the traction wheel, the second transmission wheel and the second brake part rotate, the second brake part and the second transmission wheel on opposite sides of the traction wheel.

16. The drive machine according to claim 1, wherein the brake and the motor are side by side.

17. An elevator, comprising:

an elevator car;

a counterweight;

a drive machine; and hoisting ropes connecting the elevator car and the counterweight and passing around a traction wheel of the drive machine, wherein the drive machine is as defined in claim 1.

18. The elevator according to claim 17, wherein the hoisting ropes pass from the traction wheel on the first side of it to the counterweight and on the second side of it to the elevator car and wherein the drive shaft is between the portion of the hoisting ropes passing from the traction wheel to the counterweight and the portion of the hoisting ropes passing from the traction wheel to the elevator car.

19. The elevator according to claim 17, wherein the hoisting ropes pass from the traction wheel on the first side of it to a first diverting wheel and further to the counterweight and on the second side of it to a second diverting wheel and further to the elevator car and wherein the drive shaft is between the portion of the hoisting ropes passing from the traction wheel to the first diverting wheel and the portion of the hoisting ropes passing from the traction wheel to the second diverting wheel.

20. The elevator according to claim 19, wherein the first and second diverting wheels as well as the drive shaft are all horizontally on the same side of the traction wheel.

* * * * *